US012078015B2

(12) United States Patent
Eyre et al.

(10) Patent No.: US 12,078,015 B2
(45) Date of Patent: Sep. 3, 2024

(54) POLYCRYSTALLINE DIAMOND CUTTING ELEMENT HAVING IMPROVED CUTTING EFFICIENCY

(71) Applicant: Schlumberger Technology Corporation, Sugar Land, TX (US)

(72) Inventors: Ronald K. Eyre, Orem, UT (US); Yi Fang, Orem, UT (US); Ronald B. Crockett, Mt. Pleasant, UT (US); Lynn Belnap, Spanish Fork, UT (US); Aaron Madsen, Saratoga Springs, UT (US); Haibo Zhang, Lehi, UT (US); J. Daniel Belnap, Lindon, UT (US); Christopher A. Tucker, Provo, UT (US); Xiaoge Gan, Houston, TX (US); Anjie Dong, Spring, TX (US); Venkatesh Karuppiah, The Woodlands, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 151 days.

(21) Appl. No.: 17/639,021

(22) PCT Filed: Aug. 28, 2020

(86) PCT No.: PCT/US2020/048310

§ 371 (c)(1),
(2) Date: Feb. 28, 2022

(87) PCT Pub. No.: WO2021/041753

PCT Pub. Date: Mar. 4, 2021

(65) Prior Publication Data

US 2022/0307325 A1 Sep. 29, 2022

Related U.S. Application Data

(60) Provisional application No. 62/893,831, filed on Aug. 30, 2019.

(51) Int. Cl.
*E21B 10/567* (2006.01)

(52) U.S. Cl.
CPC ..... *E21B 10/5673* (2013.01)

(58) Field of Classification Search
CPC ..... E21B 10/5673
See application file for complete search history.

(56) References Cited

U.S. PATENT DOCUMENTS 8,087,478 B2 1/2012 Patel
8,191,656 B2 6/2012 Dourfaye et al.
(Continued)

FOREIGN PATENT DOCUMENTS

CN 109681125 A * 4/2019 ..... E21B 10/46

OTHER PUBLICATIONS

International Search Report and Written Opinion in International Patent Application No. PCT/US2020/048310 on Dec. 4, 2020, 12 pages.

*Primary Examiner* — Dany E Akakpo
(74) *Attorney, Agent, or Firm* — Jeffrey D. Frantz

(57) ABSTRACT

A cutting element may include a body, a concave cutting face formed at a first end of the body, the cutting face including one or more cutting ridges adjacent a cutting tip that are raised above the concavity of the cutting face and having a length that is at least about 10% of a diameter of the cutting face. An edge is formed around a perimeter of the cutting face, and the edge has an edge angle defined between a tangent of the cutting face and a cylindrical side surface of the body, the edge angle being acute at the cutting tip and varying around the perimeter of the cutting face.

19 Claims, 13 Drawing Sheets

(56) References Cited

U.S. PATENT DOCUMENTS

| | | | | |
|---|---|---|---|---|
| 9,303,461 | B2 | 4/2016 | Patel et al. | |
| 10,240,399 | B2 | 3/2019 | Rahmani | |
| 11,098,532 | B2 | 8/2021 | Gan et al. | |
| 2010/0084198 | A1* | 4/2010 | Durairajan ..... | E21B 10/55 175/425 |
| 2010/0243334 | A1 | 9/2010 | Dourfaye et al. | |
| 2015/0047913 | A1 | 2/2015 | Durairajan et al. | |
| 2016/0158921 | A1 | 6/2016 | Stockey et al. | |
| 2019/0071933 | A1 | 3/2019 | Gan et al. | |

* cited by examiner

POLYCRYSTALLINE DIAMOND CUTTING ELEMENT HAVING IMPROVED CUTTING EFFICIENCY

This application is the U.S. National Phase of International Patent Application No. PCT/US2020/048310, filed Aug. 28, 2020, and entitled "POLYCRYSTALLINE DIAMOND CUTTING ELEMENT HAVING IMPROVED CUTTING EFFICIENCY," which claims priority to and the benefit of U.S. Provisional Patent Application No. 62/893,831, filed on Aug. 30, 2019, each of which is hereby incorporated by reference in its entirety.

BACKGROUND

Fixed cutter drill bits are widely used in the petroleum and mining industry for drilling wellbores through earth formations. The bits typically include a bit body with a threaded connection at a first end for attaching to a drill string and cutting structure formed at an opposite end for drilling through earth formation. The cutting structure typically includes a plurality of blades that extend radially outwardly from a longitudinal axis of the bit body. Ultrahard compact cutters are typically mounted in sockets formed in the blades and affixed thereto by press fitting or brazing. Fluid ports may be positioned in the bit body to distribute fluid around the cutting structure of the bit and flush formation cuttings away from the cutters and borehole bottom during drilling.

Cutters used for fixed cutter drill bits typically include ultrahard compacts which include a layer of ultrahard material bonded to a substrate of less hard material through a high pressure/high temperature (HP/HT) sintering process, a brazing process, mechanical locking, or other means known in the art. For example, cutters may be formed having a substrate or support stud made of carbide, for example tungsten carbide, and an ultrahard cutting surface layer or table made of a polycrystalline diamond or polycrystalline boron nitride material deposited onto or otherwise bonded to the substrate at an interface surface. Cutters are conventionally cylindrical in form with circular cross sections.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Embodiments disclosed herein relate to a cutting element that includes a body, a concave cutting face formed at a first end of the body, the cutting face including one or more cutting ridges adjacent a cutting tip that are raised above the concavity of the cutting face and having a length that is at least about 10% of a diameter of the cutting face. An edge is formed around a perimeter of the cutting face, the edge having an edge angle defined between a tangent of the cutting face and a cylindrical side surface of the body, the edge angle being acute at the cutting tip and varying around the perimeter of the cutting face.

Embodiments disclosed herein relate to a cutting element that includes a body, a concave cutting face formed at a first end of the body, the cutting face including one or more cutting ridges that are raised above the concavity of the cutting face. An edge is around a perimeter of the cutting face, the edge having an edge angle defined between a tangent of the cutting face and a cylindrical side surface of the body, the edge angle being acute at a cutting tip and varying around the perimeter of the cutting face. The cutting face includes a center dome that is raised above the concavity and is at a distance from the cutting tip.

Embodiments disclosed herein relate to a cutting tool that includes a tool body and at least one cutting element attached to the tool body. The cutting element includes a body, a concave cutting face formed at a first end of the body, the cutting face including one or more cutting ridges that are raised above the concavity of the cutting face and having a length that is at least about 10% of a diameter of the cutting face. An edge is around a perimeter of the cutting face, the edge having an edge angle defined between a tangent of the cutting face and a cylindrical side surface of the body, the edge angle being acute at a cutting tip and varying around the perimeter of the cutting face.

Embodiments disclosed herein relate to a cutting tool that includes a tool body, and at least one cutting element attached to the tool body. The cutting element includes a body, a concave cutting face formed at a first end of the body, the cutting face including one or more cutting ridges that are raised above the concavity of the cutting face. An edge is around a perimeter of the cutting face, the edge having an edge angle defined between a tangent of the cutting face and a cylindrical side surface of the body, the edge angle being acute at a cutting tip and varying around the perimeter of the cutting face. The cutting face includes a center dome that is raised above the concavity at a distance from the cutting tip.

Other aspects and advantages of the claimed subject matter will be apparent from the following description and the appended claims.

DETAILED DESCRIPTION

Embodiments disclosed herein may relate generally to cutting elements having a concave cutting face that may allow for a more positive rake angle than conventional cutters, thereby providing high cutting efficiency. Specifically, cutting elements in accordance with one or more embodiments of the present disclosure may include a concave cutting face that includes one or more cutting ridges raised above the concavity of the cutting face. The one or more cutting ridges may be disposed adjacent to a cutting tip. As described herein, the cutting face may have an edge formed around its perimeter that has an edge angle that is defined by a tangent of the cutting face and a cylindrical side surface of the body. The edge angle may be acute at the cutting tip and vary around the perimeter of the cutting face.

Figure 1A:
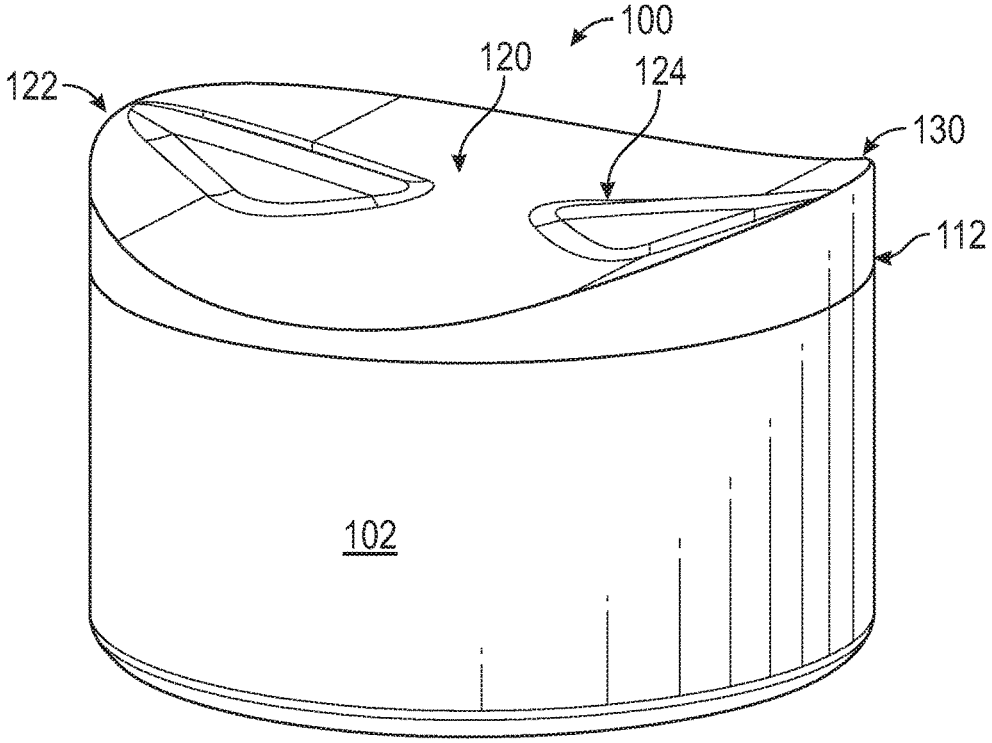
FIGS. 1A-1C are a perspective, a top-down, and a cross-sectional view, respectively, of a cutting element according to one or more embodiments of the present disclosure.
Figure 1B:
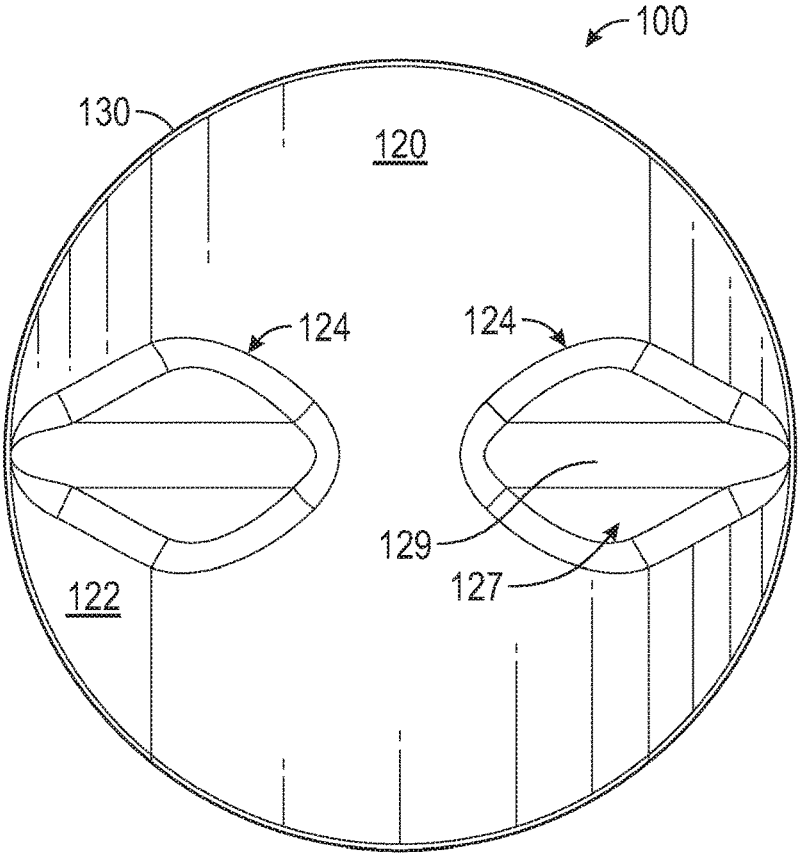
Figure 1C:
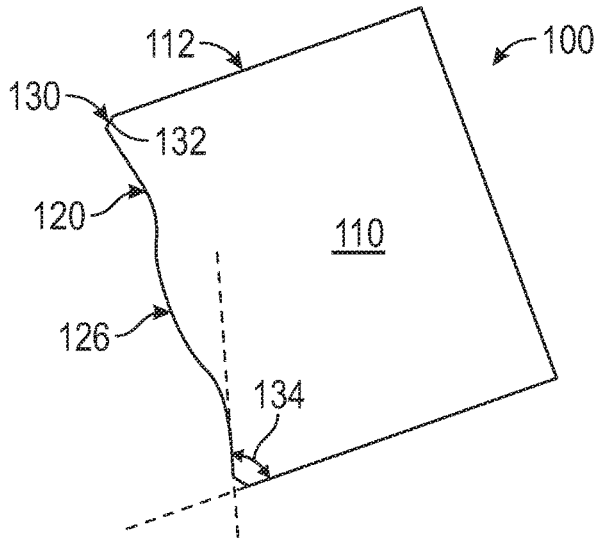

FIGS. 1A-C are perspective and cross-sectional views of cutting elements according to one or more embodiments of the present disclosure. The cutting element 100 includes a body 110 and a cutting face 120 that is formed at a first end portion of the body 110. In some embodiments, the body may include a cutting layer on a substrate 102, where the cutting face 120 is formed on the face of the cutting layer opposite the interface with the substrate 102. The cutting face 120 may be concave (e.g., generally concave), which is intended to reflect the overall curvature of the face, in particular across the diameter of the cutting face. For example, as illustrated, the cutting face is not axisymmetric but has two outer raised regions 122 (forming the peak height(s) of the cutting face and the cutting tip of the cutting element) spaced apart from and on opposite sides of the cutting face 120, such that the cutting face has a reduced height moving radially inward towards the center. For clarity, as used herein, a concave cutting face includes a generally concave cutting face, e.g., a cutting face as described herein where the cutting face also includes discrete regions of convexity. Specifically, the concave (e.g., generally concave) cutting face 120, as illustrated, has one or more cutting ridges 124 proximate the raised regions 122 (and cutting tip) that are raised above the concavity of the cutting face 120. The surface geometry of the cutting face 120 may be symmetric about the plane of the cross-sectional view in FIG. 1C, as well as symmetric about a plane perpendicular to the cross-sectional plane. FIG. 1C does not show the cutting ridges 124 for clarity.

Cutting elements in accordance with the present disclosure generally include at least one cutting ridge 124 on the cutting face 120. The cutting ridges are raised from the cutting face so that when the cutting face is concave, for example, the ridges are raised above the concavity (e.g., above the general concavity) of the cutting face. The cutting ridges 124 of one or more embodiments of the present disclosure include two side portions 127 that are joined together at a top line 129. The top line of the cutting ridge runs along the length of the ridge and is disposed at the interface of the two side portions. The top line of the cutting ridge, along its length, may be concave, convex, serrated, or planar in shape, relative to the cutting face (i.e., along the z-axis). The top line of some embodiments, in a view perpendicular to the length, may be curved and, in particular embodiments, possess a radius having a lower limit of any of 0.030, 0.040, or 0.050 inches to an upper limit of any of 0.100, 0.125, or 0.150 inches, where any lower limit can be used in combination with any upper limit. In some embodiments, the cutting ridges may vary in thickness along their length, and can transition from either thin to thick or thick to thin along a radial direction from the center of the cutting face. The cutting ridges of one or more embodiments may have an inclusive angle ranging from a lower limit of any of about 60, 70, 80, 90, 100, or 125 to an upper limit of any of about 155, 160, 165, or 170 degrees, where any lower limit can be used in combination with any upper limit.

The cutting ridges may have any length suitable for the intended function of the cutting element. In some embodiments, the length of the cutting ridge may be measured as a percentage of a diameter of the cutting face. For example, in one or more embodiments, the cutting ridge may have a length of at least 5%, of least 10%, of at least 20%, or of at least 30% of a diameter of the cutting face. In embodiments where more than one cutting ridge is present, the ridges may be all the same length or they may each have a different length. In some embodiments, cutting ridges in accordance with the present disclosure may have a textured surface that, for instance, may include bumps or ripples.

In one or more embodiments depicted by FIGS. 1A and 1B, the cutting face 120 has two-fold rotational symmetry (discrete rotational symmetry of the second order) about a longitudinal axis, where the geometric configuration of the cutting element is the same when the cutting face is rotated 180° around the longitudinal axis. In some embodiments, a cutting face may be asymmetric, having one-fold rotational symmetry (where the geometric configuration of the cutting element remains the same after a complete 360° rotation about the longitudinal axis), for example, when the cutting face surface geometry includes a single outer raised region formed along less than the entire perimeter of the cutting face. In some embodiments, a cutting face may have three-fold rotational symmetry (where the geometric configuration of the cutting element is the same when the cutting face is rotated 120° around the longitudinal axis), for example, when the cutting face surface geometry includes three outer raised regions formed along the perimeter of the cutting face. In some embodiments, a cutting face may have four-fold (or more) rotational symmetry. In one or more embodiments, a cutting face may include two or more cutting ridges that are substantially parallel to one another. In some embodiments, two or more cutting ridges may be related by a mirror plane that intersects the center of the cutting face and is perpendicular to the plane of the cutting face. In some embodiments, the mirror plane may be perpendicular to the longest dimension of the two or more ridges. In other embodiments, the mirror plane may be parallel to the longest dimension of the two or more ridges.

An edge 130 is formed around a perimeter of the cutting face 120 at the junction between the cutting face 120 and a side surface 112 of the cutting element 100. In some embodiments, such as shown in FIG. 1C, the edge 130 may include a chamfer or bevel 132 formed at the junction between the cutting face 120 and the side surface 112, while in other embodiments, at least part of an edge may be formed at the junction of the cutting face and side surface without a bevel or chamfer. Further, it is also understood that edge 130 may include multiple bevels, radii, or combinations of these. Any bevel may be continuous, multifaceted, or non-continuous around the periphery of the cutter.

The shape of an edge 130 may be described according to its cross-sectional profile along a plane intersecting the edge and perpendicular to the side surface at the edge. For example, a profile of an edge may include a curved transition between the cutting face and side surface portions at the edge, a bevel formed at the junction between the cutting face and side surface portions at the edge, or an angled transition between the cutting face and side surface portions at the edge. Further, an edge may have an edge angle defined between the cutting face and the side surface of the cutting element. For example, as shown in FIG. 1C, a line tangent to the cutting face 120 at edge 130 and a line tangent to the side surface 112 at edge 130 intersect to define an edge angle 134. The edge angle 134 may vary around the perimeter of the cutting face 120. For example, the portions of the edge 130 shown in the cross-sectional profile of FIG. 1C have an acute edge angle 134. Other portions of the edge 130 may have right or obtuse edge angles, such as along portions of the edge 130 that are not proximal to the outer raised regions 122.

Non-planar cutting faces according to embodiments of the present disclosure may include an undulating surface geometry, where relatively raised portions form two sides of the edge of a cutting element. In some embodiments, at least one raised portion may be formed between the outer raised portions at the edge and spaced apart by relatively depressed portions. For example, a single central raised portion in the shape of a ridge may be spaced between outer raised portions at a cutting element edge, or more than one ridge may be spaced between outer raised portions of a cutting element edge, where each raised portion may be spaced apart from each other by a relatively depressed portion. In some embodiments, a single central raised portion may be dome shaped, i.e., the central raised portion does not extend across the entire diameter of the cutting element but may be spaced a distance from the entire periphery. It is envisioned that the single central raised portion may be axisymmetric or not. In some embodiments, the single central raised portion may extend across a full width or diameter of the cutter, although in other embodiments a single central raised portion may extend along a partial width or diameter of the cutter. In embodiments in which a raised portion extends across a partial width or diameter of the cutter, the raised portion may extend from an outer edge toward a center or axis of the cutting face, or may extend from the center of the cutting face radially outward in a single or in each of opposing directions toward an outer edge.

FIG. 1C depicts one or more embodiments that may feature a center dome 126. The center dome is raised from the cutting face so that, for instance, when the cutting face is concave, the center dome is raised above the concavity (e.g., above the general concavity) of the face. In some embodiments, the center dome may be disposed at a distance from one or more of the outer raised regions 122. The center dome may be disposed at a distance from the cutting tip.

In one or more embodiments, one or more cutting ridges may be sufficiently long as to intersect the center dome. When the dome is intersected by a cutting ridge, the cutting ridge may be disposed at most equal in height with the dome. This may enable more efficient lifting and peeling of the formation in some embodiments.

Depending on the orientation of the cutting element in a cutting tool and the relative orientation between the tool and the formation being engaged by the tool, certain portions of the edge may act as a cutting edge, which contacts and engages the formation. As used herein, the cutting tip is the first point of the cutting edge that contacts the formation upon increasing the cutting depth from 0. In some embodiments, cutting elements may be in a cutter pocket formed on a cutting tool such that a portion of the edge having an acute edge angle forms the cutting edge. In some embodiments, cutting elements may be oriented in a cutter pocket formed on a cutting tool such that a right or obtuse edge angle portion of the edge forms the cutting edge of the cutting element. Further, in some embodiments, a cutting element having a non-planar surface geometry, such as disclosed herein, may be rotated within a cutter pocket to alter the edge angle portion acting as the cutting edge, thereby altering the effective back rake angle (or engagement angle). In some embodiments, a cutting element having a first surface geometry (e.g., a planar or non-planar surface geometry) may be replaced with a cutting element having a non-planar surface geometry described herein to alter the edge angle acting as the cutting edge, thereby altering the engagement angle of the cutting element.

As used herein, an engagement angle refers to the angle measured between a line tangent to the portion of the cutting face to engage a formation and a line perpendicular to the formation being engaged (or working surface). The portion of a cutting face that engages a formation may depend on, for example, the distance the cutting element protrudes (extension height) from an outermost surface of the cutting tool on which the cutting element is disposed and the depth of cut of the cutting element. With cutting elements having a non-planar cutting face geometry at the cutting edge, such as disclosed herein, the engagement angle measured along the engagement area of the non-planar cutting face may vary along the depth of cut.

Figure 2A:
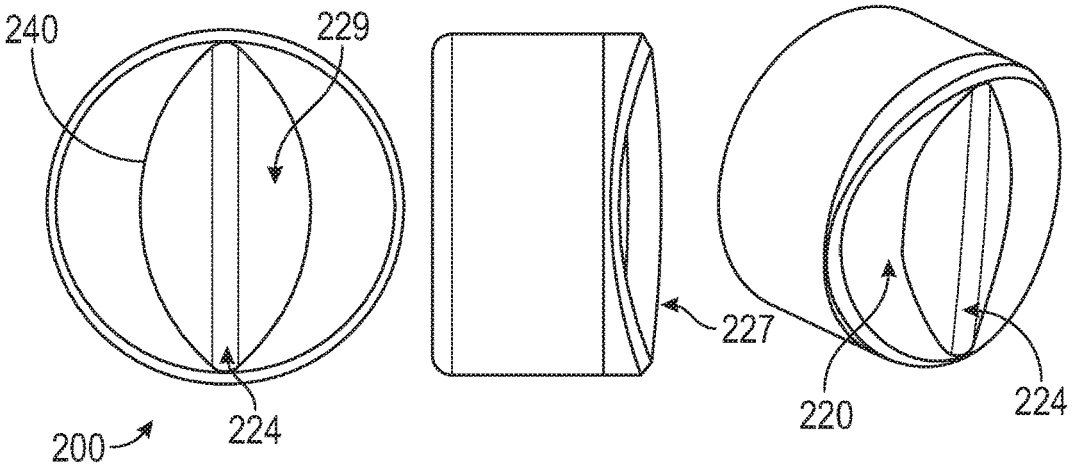
FIGS. 2A-D are perspective views of cutting elements according to one or more embodiments of the present disclosure.
Figure 2B:
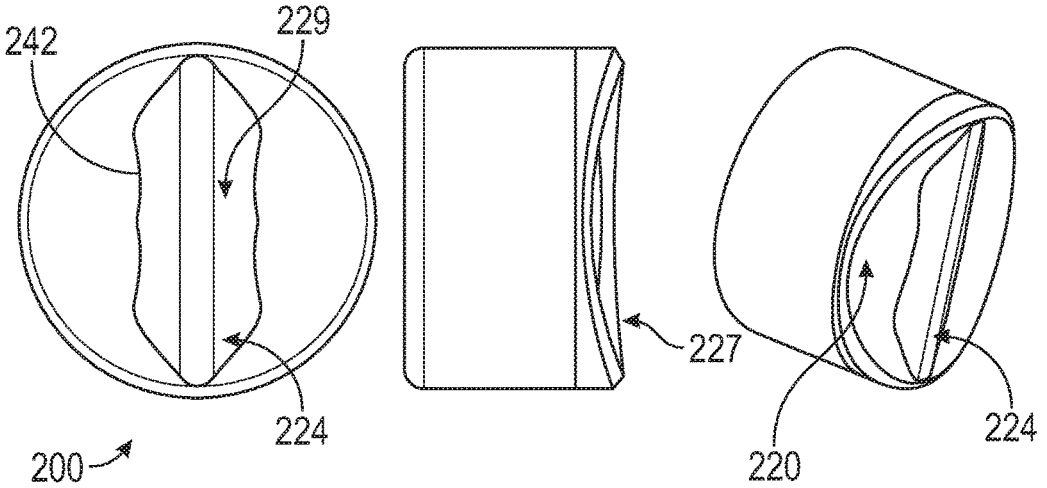
Figure 2C:
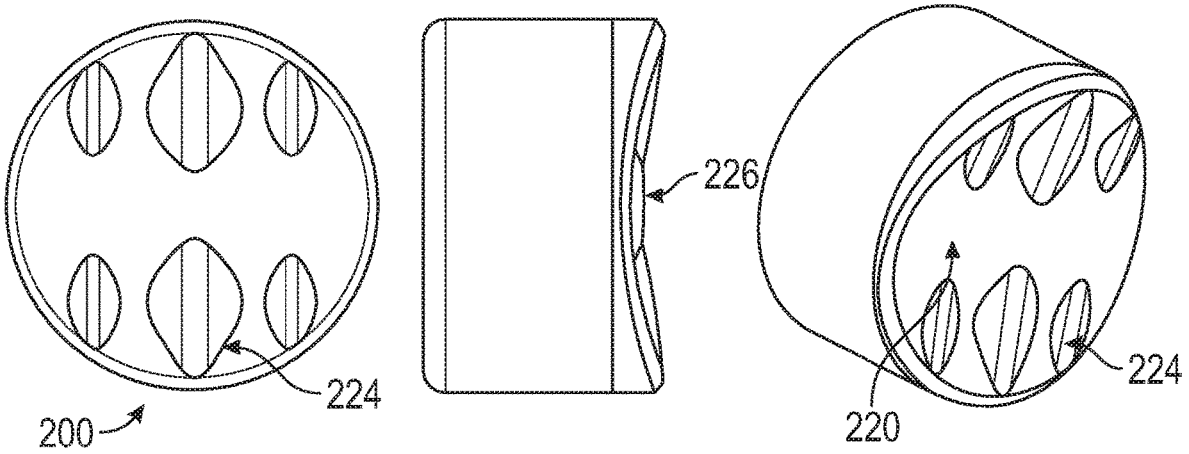
Figure 2D:
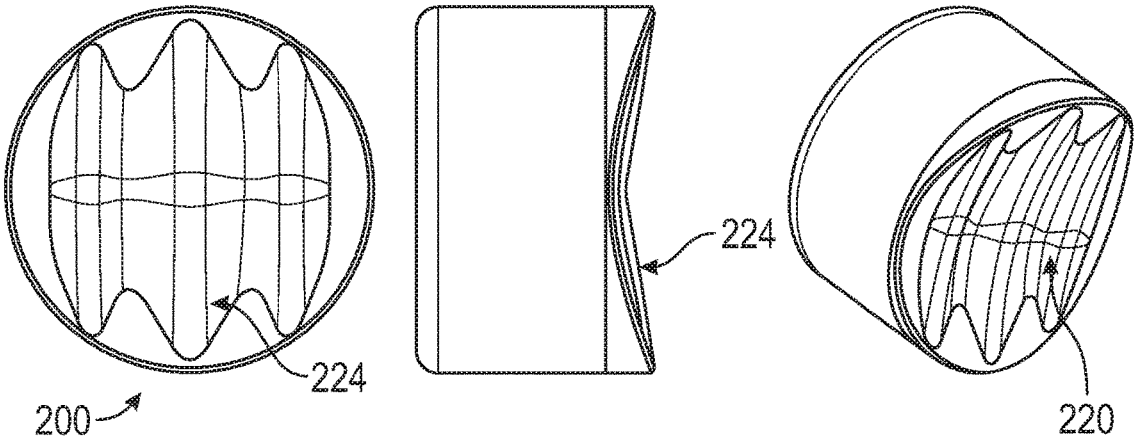

In one or more embodiments, cutting ridges in accordance with the present disclosure may be located in close proximity to the cutting edge. In some embodiments, one or more cutting ridges may be disposed generally, or substantially, perpendicular to a tangent of the edge at the cutting tip. In some embodiments, one or more cutting ridges may be radially disposed on the cutting face. FIGS. 2A-F illustrate examples of different cutting elements that are in accordance with one or more embodiments of the present disclosure. For example, FIGS. 2A-B shows a cutting element 200 having concave (e.g., generally concave) cutting face with a single cutting ridge 224 that extends across the entire diameter of the cutting face (in contrast to FIGS. 1A-C, which shows cutting ridges extending less than the diameter). The side portions 229 of cutting ridges 224 varies as illustrated in FIGS. 2A-B, with FIG. 2A showing a convex transition 240 between side portion 229 and the concavity and FIG. 2B showing a concave transition 242. Further, the top line 227 of cutting ridge 224 in FIG. 2A is convex, while it is concave in FIG. 2B. FIGS. 2C-D shows other embodiments having a plurality of cutting ridges, and as illustrated, a plurality of cutting ridges 224 at each outer raised region (in contrast to FIGS. 1A-C, which shows only one cutting ridge at each outer raised region). Similar to FIGS. 1A-C, the cutting ridges 224 in FIG. 2C do not extend the entire diameter (or chord) of the cutting face 220, whereas the cutting ridges 224 in FIG. 2D do extend the entire diameter and/or chord of the cutting face. As the cutting ridges 224 in FIG. 2C do not extend the entire diameter of the cutting face, the center dome 226 may be more apparent. The cutting ridges 224 in FIG. 2D may be raised above the concavity (e.g., above the general concavity) of cutting face 220, but may have a similar or substantially similar profile as the underlying cutting face 220. Outer ridges may be such that these are radially oriented, perpendicular to the cutting surface as shown, or any other orientation. These also may be curved instead of straight. The ridges could be serrated as well.

Figure 3:
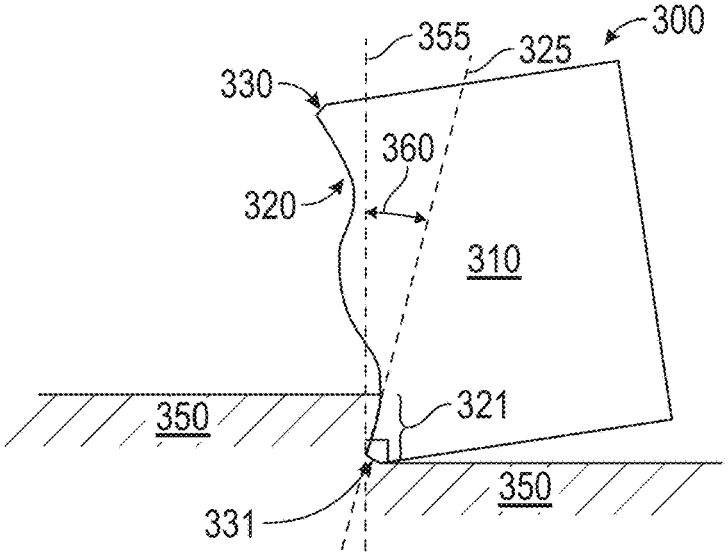
FIG. 3 is a cross-sectional view of a cutting element according to one or more embodiments of the present disclosure.
Figure 4:
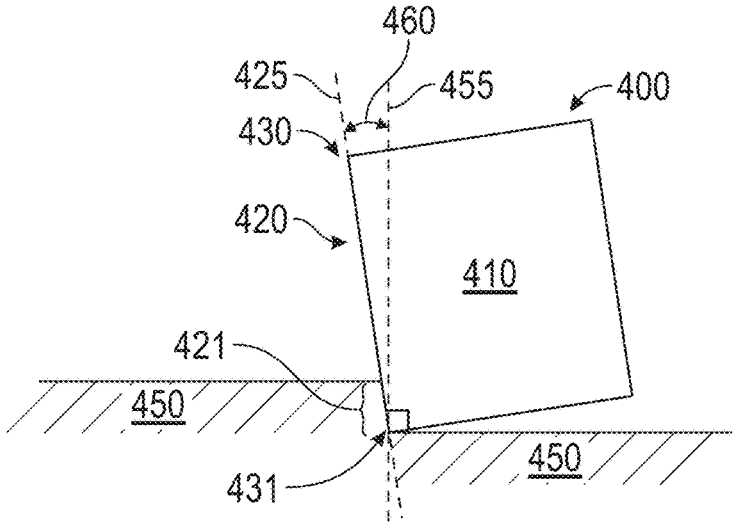
FIG. 4 is a cross-sectional view of a cutting element according to one or more embodiments of the present disclosure.
Figure 5:
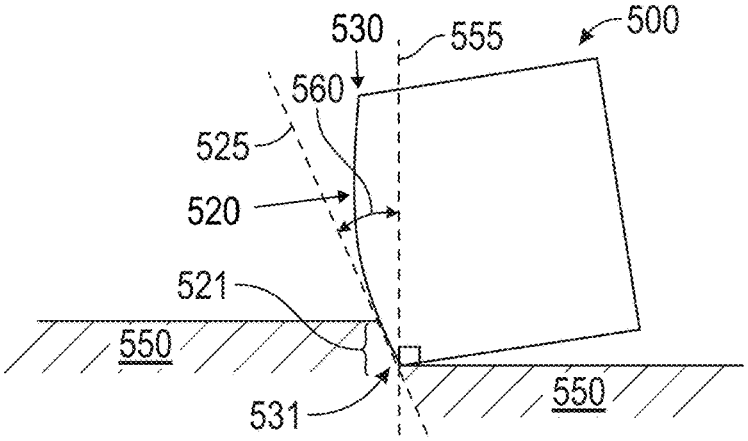
FIG. 5 is a cross-sectional view of a cutting element according to one or more embodiments of the present disclosure.

FIGS. 3-5 show examples of three different cutting profiles of a cutting element positioned at a given orientation. As shown, although each cutting element is oriented in the same position, the different surface geometry along the engagement area of the cutting face provides different engagement angles with respect to a formation being engaged.

FIG. 3 is a cross-sectional view of a cutting element 300 having a non-planar cutting face 320 formed at a first end of a body 310. The cutting element 300 may be in a cutter pocket (not shown) and have portion of the edge 330 having an acute edge angle that forms the cutting edge 331. As the cutting element is engaged with and moved across a formation 350, an engagement area 321 of the cutting face 320 extends the depth of cut into the formation 350. An engagement angle 360 is defined between the line 355 perpendicular to the formation 350 being cut and the line 325 tangent to the engagement area 321 of the cutting face 320. In the embodiment shown, the engagement area 321 of the cutting face 320 has a concave cross-sectional profile, and thus, the engagement angle 360 varies along the depth of cut. In some embodiments, a cross-sectional profile of an engagement area of a non-planar cutting face may have a planar region, where the engagement angle is constant along the depth of cut for the planar region. However, in some embodiments, the engagement area has both planar and non-planar regions or may be entirely non-planar, where the engagement angle may vary along the depth of cut engaging the varying regions of the engagement area.

According to embodiments of the present disclosure, an engagement angle 360 formed at an acute edge angle portion of a cutting element may be positive, for example, within a range having a lower limit, an upper limit, or both lower and upper limits including any of 0°, 2°, 5°, 10°, 15°, 20°, 25°, 30°, 40°, 50°, or any values therebetween, where any relatively lower value may be selected in combination with any relatively higher value. If engagement angles disclosed herein were to be considered in terms of back rake angles for conventional cutting angles, positive back rake angles may not be achievable at the values described herein.

Further, in some embodiments of the present disclosure, an engagement angle 360 varying along a depth of cut may have a difference in value of greater than 2°, for example, up to 5°, up to 10°, or more. For example, an engagement angle formed along an engagement area having a concave cross-sectional profile may have a difference in engagement angles along the depth of cut of ranging from about 5° to about 15°, or more, depending on the radius of curvature of the concave cross-sectional profiles.

FIG. 4 is a cross-sectional view of a cutting element 400 in a cutter pocket at the same orientation (i.e., same angle between the longitudinal axis of the cutting element and the line perpendicular to the formation) as the cutting element 300 of FIG. 3, where the cutting element 400 is positioned in the cutter pocket to have a right edge angle portion of the edge 430 form the cutting edge 431 of the cutting element. As the cutting element is engaged with and moved across a formation 450, an engagement area 421 of the cutting face 420 extends the depth of cut into the formation 450. An engagement angle 460 is defined between the line 455 perpendicular to the formation 450 being cut and the line 425 tangent to the engagement area 421 of the cutting face 420. In the embodiment shown, the cutting element 400 may have a non-planar cutting face 420 formed at a first end of the body 410, where the non-planar cutting face includes a linear ridge extending between opposite sides of the edge 430, and where the cross section is taken along the linear ridge. The linear ridge may have a planar cross-sectional profile forming the right edge angle. In some embodiments, other cutting face geometries may form a right edge angle, for example a planar cutting face.

According to embodiments of the present disclosure, an engagement angle formed at a right edge angle portion of a cutting element may be negative, for example, having a lower limit, an upper limit, or both lower and upper limits including any of 0°, −2°, −5°, −10°, −15°, −20°, −25°, −30°, or any values therebetween, where any relatively lower value may be selected in combination with any relatively higher value. The engagement angle may be constant along the planar cross-sectional profile of the engagement area 421.

FIG. 5 is a cross-sectional view of a cutting element 500 in a cutter pocket at the same orientation as the cutting elements 300, 400 of FIGS. 3 and 4, where the cutting element 500 is positioned in the cutter pocket to have an obtuse edge angle portion of the edge 530 from the cutting edge 531 of the cutting element. The obtuse edge angle portion of the edge 530 may be formed by a convex ridge extending between opposite sides of the edge 530, where the convex ridge has a convex profile extending outwardly from a base surface of the cutting element 500. In some embodiments, other cutting face geometries may form an obtuse edge angle, for example, a planar surface extending upwardly and radially inward from the edge. As the cutting element is engaged with and moved across a formation 550, an engagement area 521 of the cutting face 520 extends the depth of cut into the formation 550. An engagement angle 560 is defined between the line 555 perpendicular to the formation 550 being cut and the line 525 tangent to the engagement area 521 of the cutting face 520.

According to embodiments of the present disclosure, an engagement angle formed at an obtuse edge angle portion of a cutting element may be negative, for example, within a range having a lower limit, an upper limit, or lower and upper limits including any of −5°, −10°, −15°, −25°, −30°, −40°, −50°, or any value therebetween, where any relatively lower value may be selected in combination with any relatively higher value. The engagement angle may vary along the convex cross-sectional profile of the engagement area 521. In some embodiments, an engagement angle varying along a depth of cut may have a difference in value of greater than 2°, for example, up to 5°, up to 10°, or more. For example, an engagement angle formed along an engagement area having a convex cross-sectional profile may have a difference in engagement angles along the depth of cut of ranging from about 5° to about 15°, or more, depending on the radius of curvature of the convex cross-sectional profile. In embodiments having an obtuse edge angle with a planar surface forming the engagement area cross-sectional profile, the engagement angle may be constant or varied along the depth of cut.

FIGS. 3-5 show how cutting elements having non-planar cutting faces according to embodiments of the present disclosure may be rotated and positioned within a cutter pocket at a given orientation to vary the engagement angle of the cutting element. Similarly, cutting elements having a first type of cutting face surface geometry (e.g., a planar cutting face or a non-planar cutting face) may be replaced with cutting elements having a non-planar cutting face according to embodiments of the present disclosure to alter the engagement angle.

Figure 6A:
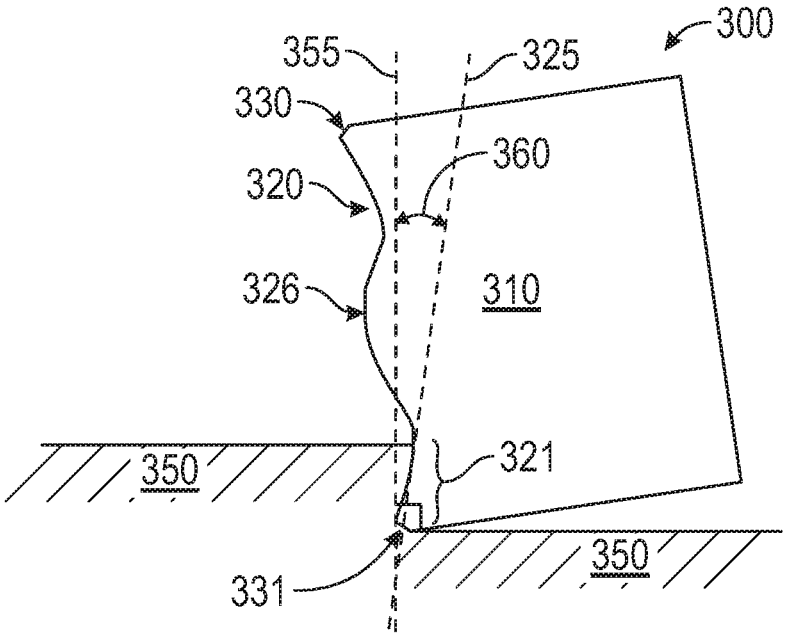
FIGS. 6A-B are cross-sectional views of a cutting element according to one or more embodiments of the present disclosure.
Figure 6B:
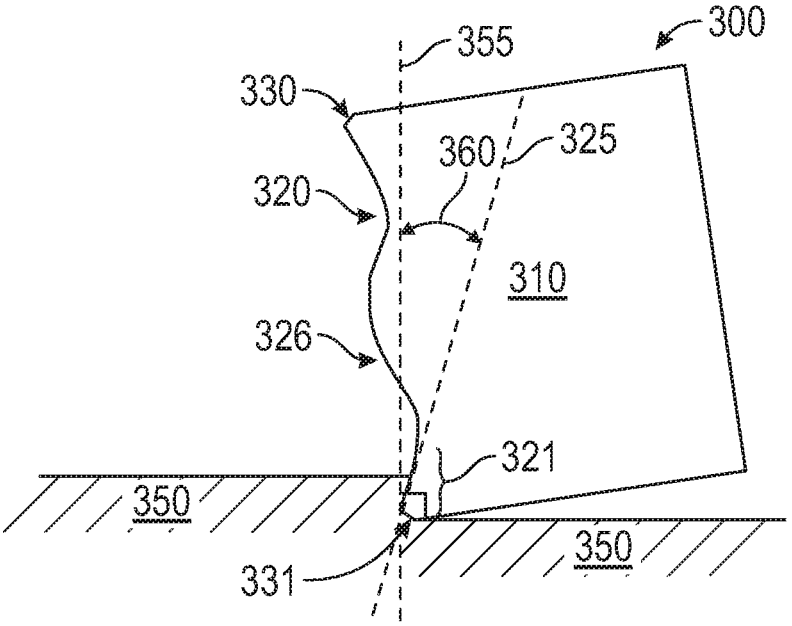

Further, an engagement angle formed by a non-planar cutting face according to embodiments of the present disclosure may vary depending on the depth of cut. For example, FIGS. 6A and 6B show the cutting element shown in FIG. 3 cutting at different depths of cut. Due to the curved profile of the cutting face region contacting the formation 350 being cut, the engagement angle 360 at the surface of the formation in the relatively deeper depth of cut shown in FIG. 6A is relatively smaller than the engagement angle 360 at the surface of the formation in the relatively shallower depth of cut shown in FIG. 6B.

Non-planar cutting faces according to embodiments of the present disclosure may include an undulating surface geometry, where relatively raised portions form two opposite sides of the edge of a cutting element. In some embodiments, at least one raised portion may be formed between the outer raised portions at the edge and spaced apart by relatively depressed portions. For example, a single central raised portion (326) in the shape of a ridge may be spaced between outer raised portions at a cutting element edge, or more than one ridge may be spaced between outer raised portions of a cutting element edge, where each raised portion may be spaced apart from each other by a relatively depressed portion. In some embodiments, a single central raised portion may be dome shaped, i.e., the central raised portion does not extend across the entire diameter of the cutting element but may be spaced a distance from the entire periphery. It is envisioned that the single central raised portion may be axisymmetric or not. In some embodiments, the single central raised portion may extend across a full width or diameter of the cutter, although in other embodiments a single central raised portion may extend along a partial width or diameter of the cutter. In embodiments in which a raised portion extends across a partial width or diameter of the cutter, the raised portion may extend from an outer edge toward a center or axis of the cutting face, or may extend from the center of the cutting face radially outward in a single or in each of opposing directions toward an outer edge.

Figure 7A:
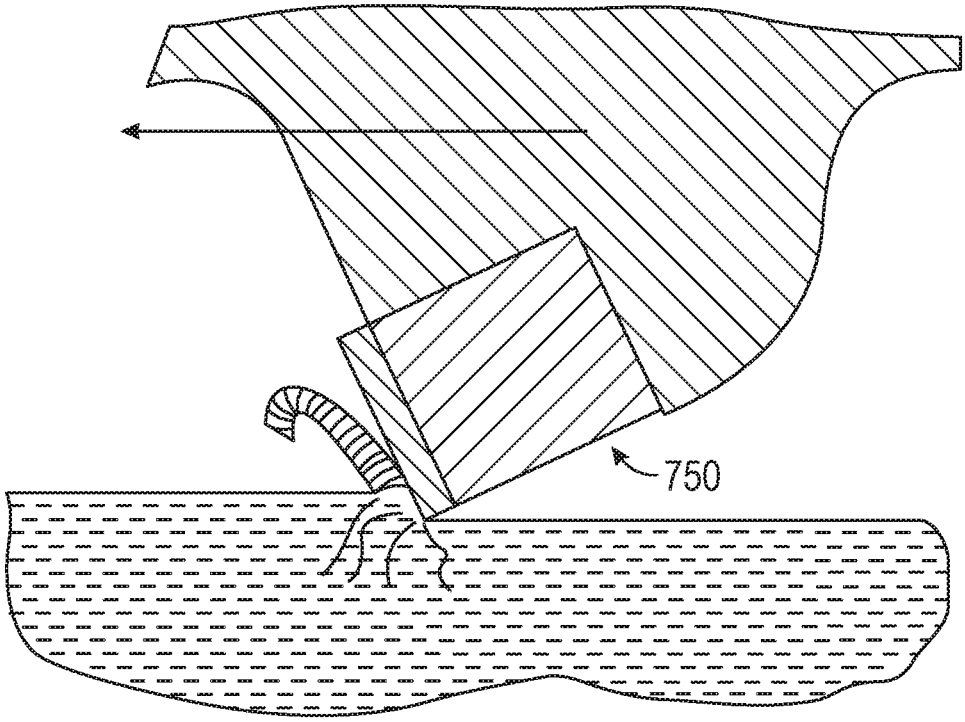
FIGS. 7A and 7B are schematic representations of the cutting mechanism of cutting elements in accordance with one or more embodiments of the present disclosure.
Figure 7B:
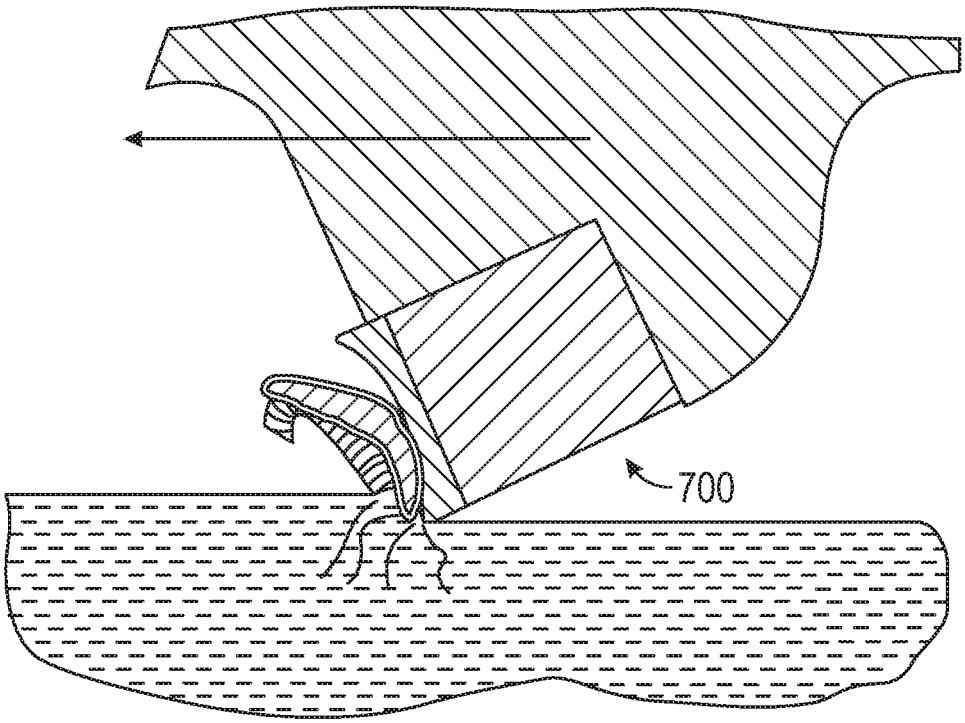

FIGS. 7A and 7B depict the cutting of two different shear cutters. FIG. 7A illustrates a standard cutter 750 that utilizes a known cutting element without a concave cutting face or cutting ridges. FIG. 7B depicts the improved cutting efficiency that is associated with the cutting elements 700 of the current disclosure. One or more embodiments of the present disclosure provide a more positive rake angle and more efficient cutting, while the presence of the cutting ridges provides better tolerance of impact loads. In further embodiments, the cutting element provides for improved chip deflection and management than is known in the art.

An edge of a cutting element according to embodiments of the present disclosure may have a bevel formed around the entire edge (such as the bevel shown in edge 830 in FIGS. 8A-8C), or a bevel/chamfer may be formed around less than the entire edge, such as along high portions of the edge. In some embodiments, a curved transition surface may be formed at the junction of the cutting face and the side surface of a cutting element. A transition surface, such as a bevel, chamfer, or a curved transition surface, may have a relatively small size compared with the size of the cutting element, and thus may be negligible or close to negligible when measuring the diameter of the cutting face and the height of the side surface of a cutting element. For example, a bevel or a curved transition surface may have a height of less than 2%, or in some embodiments, less than 7% of the total height of the cutting element and may have a radial distance of less than 2%, or in some embodiments, less than 7%.

Figure 8A:
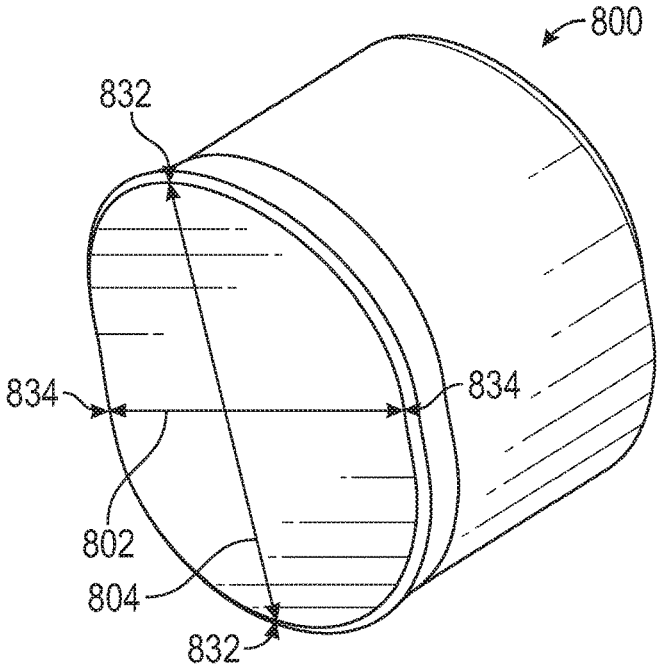
FIGS. 8A-C are perspective and various cross-sectional views of a cutting element according to one or more embodiments of the present disclosure.
Figure 8B:
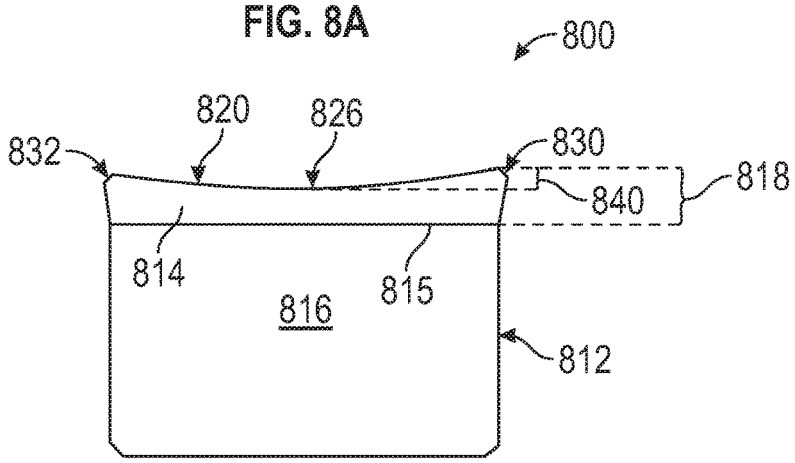
Figure 8C:
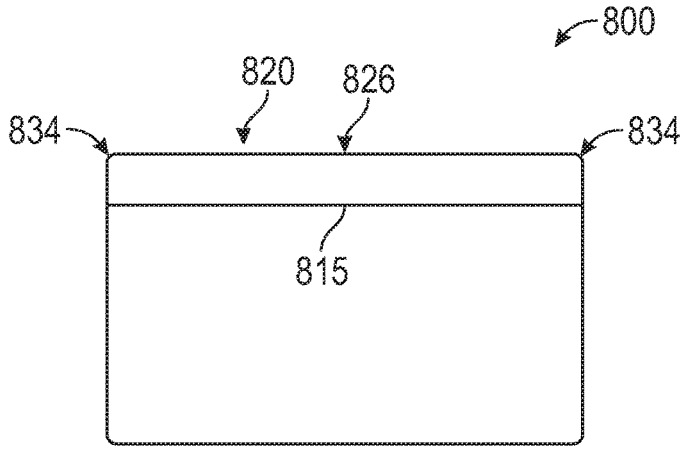
Figure 13A:
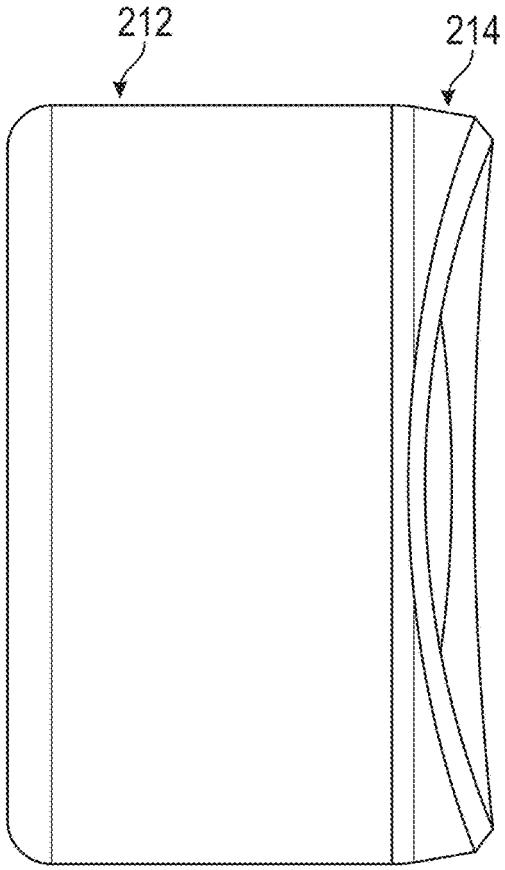
FIGS. 13A-B are side views of cutting elements according to one or more embodiments of the present disclosure.
Figure 13B:
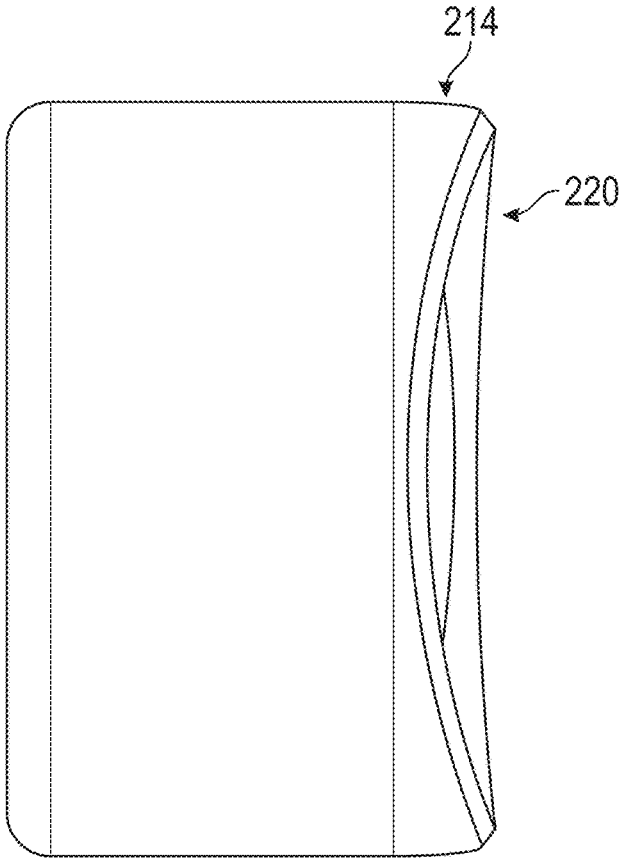

According to embodiments of the present disclosure, a cutting element may include a canted, sloped side surface extending radially outward in a direction from a base surface of the cutting element toward the cutting face of the cutting element. The entire side surface or less than the entire side surface of a cutting element may be sloped outwardly in a direction from the base surface toward the cutting face of the cutting element. FIG. 13A shows a cutting layer side surface 214 that is canted or angled, relative to the side surface of the substrate 212. FIG. 13B shows a cutting layer side surface 214 that is radiused transitioning from the side surface to the cutting face 220. For example, as shown in FIGS. 8A-8C, a portion of the side surface 812 around the cutting layer 814 may be sloped, while the entire side surface 812 around the substrate 816 may be parallel with a longitudinal axis of the cutting element 800. The sloped portion of the side surface 812 around the cutting layer 814 extends radially outward in a direction from the interface 815 to the high portions 832 of the edge 830. In other embodiments, the sloped portion may be sloped radially inward. The remaining portions of the side surface 812 extend parallel with a longitudinal axis of the cutting element, from the interface 815 to the base surface of the cutting element and from the low portions 834 of the edge 830 to the base surface of the cutting element.

In the embodiment shown in FIGS. 8A-8C, the interface 815 is planar, where the thickness of the cutting layer 814 is greatest at the high portions 832 of the edge 830 and smallest along the depressed region 826 and low portions 834 of the edge 830. In some embodiments, an interface between a substrate and a cutting layer may be non-planar. For example, an interface may have a non-planar geometry corresponding in shape and orientation to a non-planar cutting face of the cutting element. In such embodiments, the thickness of the cutting layer may be uniform along the entire cutting layer. In some embodiments, an interface may have a non-planar geometry that does not correspond in shape and/or orientation to a non-planar cutting face.

Referring still to FIGS. 8A to 8B, two low portions 834 are at the outer ends of a linear depressed region 826, where the linear depressed region 826 spaces apart two outer raised portions forming the high portions 832 of the edge 830. The linear depressed region 826 extends across a minor diameter 802 of the cutting face 820 and has a planar cross-sectional profile along a cross-section taken through the minor diameter 802, where the planar portion of the cutting face 820 forms the right edge angle portion (see cross-section of FIG. 8C). The cross-sectional profile of the cutting face 820 taken through the major diameter 804 (see cross-section shown in FIG. 8B) has a concave profile, where the cutting face 820 extends downwardly from the high portions 832 toward a central region (the linear depressed region 826) of the cutting face to depth 840. The concave profile may have a radius of curvature, which may range, for example, up to two times the major diameter 804, up to four times the major diameter 804, up to six times the major diameter 804, or up to eight times the major diameter 804. In other embodiments, the concave profile may include linear segments that form a piecewise continuous profile.

In some embodiments, the side surface of a substrate of a cutting element may extend substantially parallel with a longitudinal axis of the cutting element, and the side surface around the entire perimeter of the cutting layer of the cutting element may extend in a radially outward direction from the interface to the edge. In some embodiments, the entire side surface of a cutting element may extend radially outward from the base surface of the cutting element to the cutting face of the cutting element. In some embodiments, the side surface around one or more portions of the cutting element perimeter may have an outwardly sloping profile from the base surface to the cutting face, while one or more other portions of the side surface may extend substantially parallel to the longitudinal axis from the base surface to the cutting face.

Figure 9A:
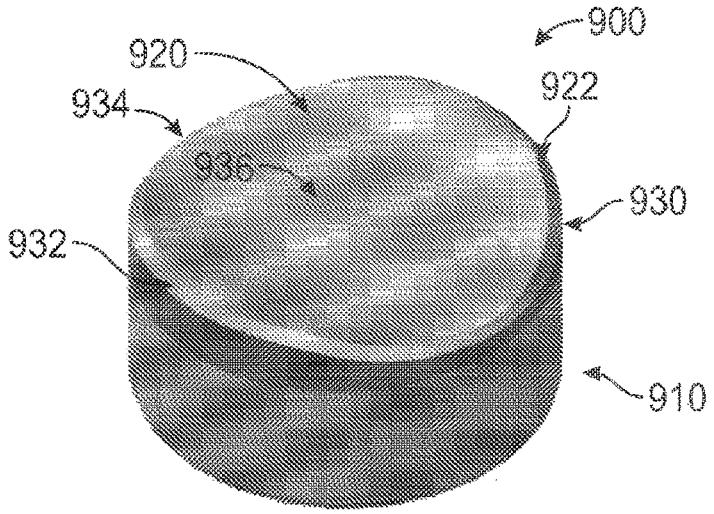
FIGS. 9A-F are views of cutting elements according to one or more embodiments of the present disclosure.
Figure 9B:
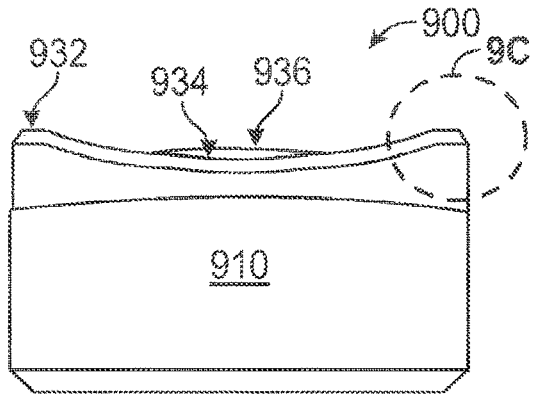
Figure 9C:
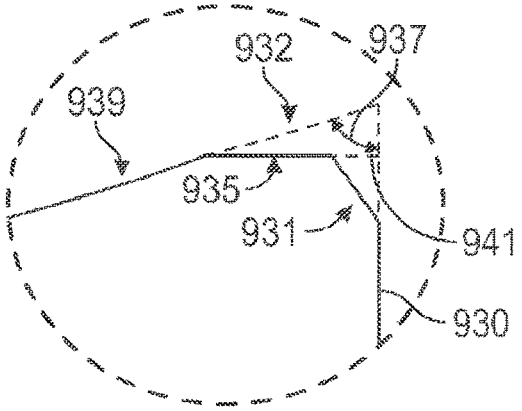
Figure 9D:
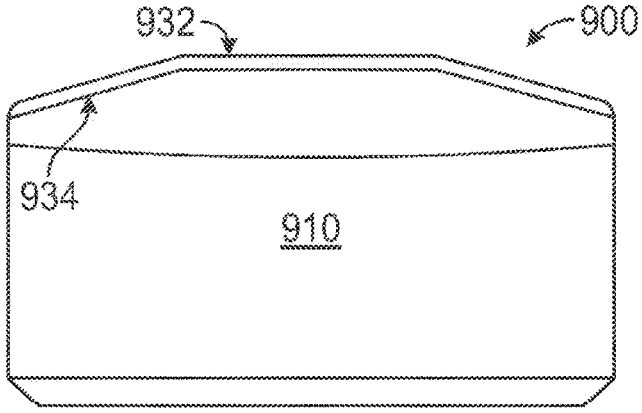
Figure 9E:
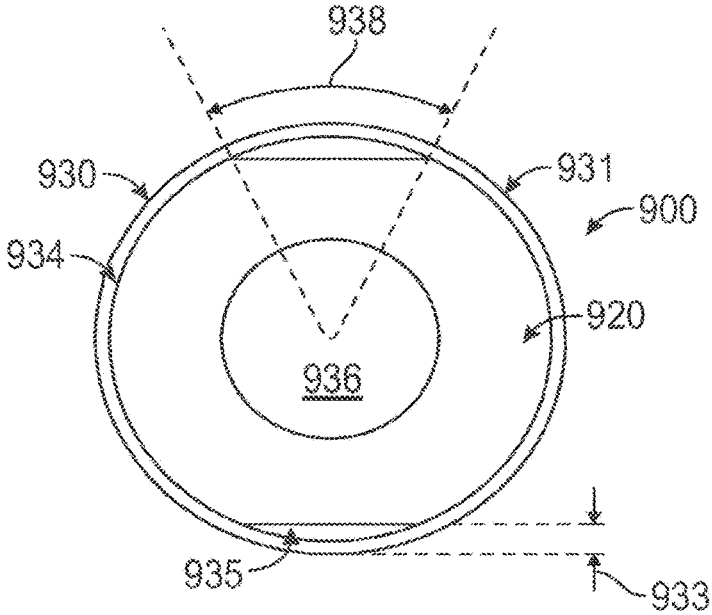

In some embodiments, a high portion at an end of a cutting element may include a planar, flat, or right surface adjacent an acute edge angle portion. FIGS. 9A-9D, for instance, illustrate various views of a cutting element 900 in accordance with some embodiments of the present disclosure. FIG. 9A is a perspective view of the cutting element 900, FIGS. 9B and 9D are side views of the cutting element 900 and FIG. 9C is an enlarged view of a raised portion of the edge of the cutting element 900 of FIG. 9B. FIG. 9E is a top view of the cutting element 900.

The cutting element 900 may have a body 910, a non-planar cutting face 920 having two outer raised regions and one or more cutting ridges disposed thereon (not shown for clarity), and an edge 930 extending around a perimeter of the non-planar cutting face 920. The height of the edge 930 varies around the perimeter of the cutting element 900, where the first, raised portion 932 of the edge 930 may extend higher than a second, depressed portion 934 of the edge 930. In one or more embodiments, the cutting element 900 may include a dome in a center of the cutting element 900, a ridge across the cutting element, and/or another raised portion 922.

The cutting element 900 differs from the above described cutting elements with respect to the edge angle by virtue of the incorporation of a flat portion adjacent the edge at the first, raised portion 932. In particular, the first, raised portion 932 may have an outermost edge angle of greater than 90° at the intersection with the bevel 931 (or with the side surface if there is no bevel 931). The first portion 932 may include a flat portion 935 (e.g., a generally flat portion) and an optional inclined portion 939. The edge angle 941 of the flat portion 935 (measured between the flat portion 935 and the side of the cutting element 900) may be about 90°, while the edge angle 937 of the inclined portion 939 may be an acute angle. At a depth of cut that exceeds the length of flat portion 935, the edge angle 937 is the effective edge angle that impacts engagement with the formation 950 and cutting efficiency. The acute edge angle 937 as measured between lines tangent to the inclined portion 939 and the side of the cutting element 900 is, in one or more embodiments, in a range that is greater than 35°, greater than 45°, or greater than 60° and up to 89°. In particular embodiments, the acute edge angle 937 may be between 65° and 75°.

Figure 9F:
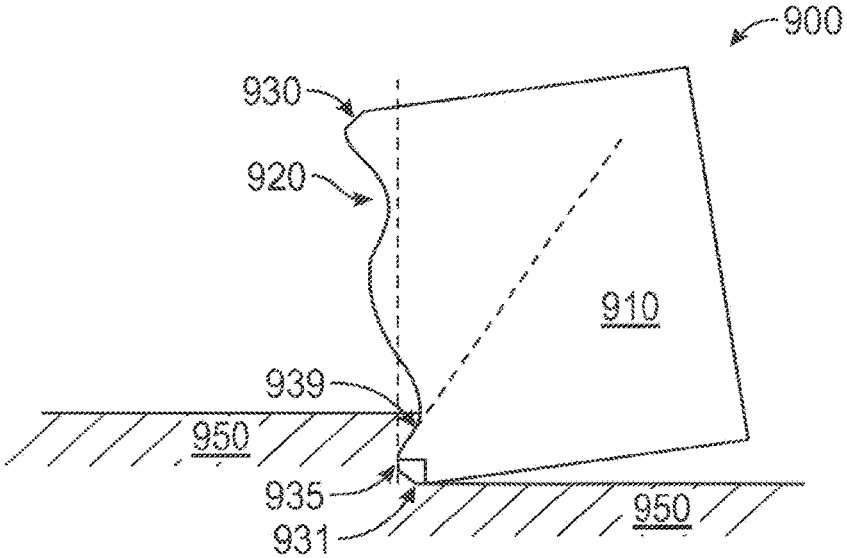

At the first portion 932, the non-planar cutting face 920 may be piecewise continuous. For instance, adjacent the edge 930, the first, raised portion 932 may start from a flat top surface and transition into a valley of the second, depressed portion 934 (e.g., at an acute edge angle 937 of 50° to 85°). The flat portion 935 has been found to provide increased edge durability, and the size of the flat portion may be varied to achieve desired cutting efficiency and durability for a specific application. As shown in FIG. 9F, the flat portion 935 may, in some embodiments, be formed as a chordal area, or chordal flat. The radial length 933 of the flat portion 935 in a radial direction (i.e., the distance between the innermost portion of the flat and the outer side surface) may, in some embodiments, range from 0.25 mm to 4 mm, from 0.5 mm and 2.5 mm, or from 1 mm and 2 mm. In some embodiments, the length 933 of the flat portion may be expressed as a percentage of the diameter of the cutting element 900, or as a percentage of the major or minor diameter for an elliptical cutting element. For instance, the length 933 may be of a range having a lower limit, an upper limit, or lower and upper limits including any of 2%, 5%, 8%, 10%, 13%, 17%, 20% of the diameter, or any values therebetween. In some embodiments, the length 933 may be between 2.5% and 13.5%, between 3.5% and 7.5%, or between 5% and 10% of the diameter (or width) of the cutting element 900.

While the flat portion 935 has been described as a chordal area, in other embodiments, the flat portion 935 may have other shapes. For instance, the flat portion 935 may not extend across a full chordal width. In other embodiments, the flat portion 935 may be annular and extend around a full or partial circumference of the cutting edge 930. In such embodiments, the length of the flat portion 935 may be constant (e.g., generally constant) around the full or partial circumference of the cutting edge 930 rather than as shown in FIG. 9E, have a variable length 933 that is greatest at the center and which decreases toward each outer end. In still other embodiments, the length 933 may vary around an annular or other shaped flat region 935.

Two flat regions 935 are shown in FIGS. 9A-F; however, any number of flat regions 935 may be used in embodiments according to the present disclosure. For instance, in some embodiments, three or four flat regions 935 may be included and spaced at equal or unequal angular intervals along the circumference of the cutting edge 930. In other embodiments, a single flat region may be used (e.g., an annular flat region). In still other embodiments, the flat regions 935 may be described in terms of the amount of circumferential coverage provided to the cutting edge 930, rather than the number of flat regions. For instance, as shown in FIG. 9E, one of the flat regions 935 may extend to provide circumferential coverage 938 ranging from about 40° to 60° of the cutting edge 930. Two flat regions 935 thereof may, therefore, provide coverage ranging from about 80° to 120° of the cutting edge 930 (i.e., between about 20% and about 35% of the periphery of the cutting edge 930). As discussed herein, the number, length, and shape of the flat regions 935 may vary. Thus, by increasing or decreasing the length of the flat regions 935, or by increasing or decreasing the number of flat regions 935, the amount of coverage could be within a range including a lower limit, an upper limit, or lower and upper limits that include any of 5%, 10%, 20%, 30%, 40%, 50%, 60%, 70%, 80%, 90%, and 100% of the cutting edge circumference or perimeter, or any values therebetween. For instance, in some embodiments, the total circumferential coverage of the one or more flat regions may be greater than 20%, less than 75%, between 5% and 75%, between 10% and 50%, or between 25% and 30%.

The third, raised portion 936 may be formed at a central region of the cutting face 920, spaced between the two first, raised portions 932 of the edge 930 having a flat portion 935 and an inclined portion 939, in which the inclined portion of the edge angles less than 90°. The raised portion 936 may also be spaced between the two second, depressed portions 934 of the edge having edge angles of about 90° or greater. The raised portion 936 may be raised and may extend a height less than, equal to, or greater than the first portions 932 of the edge 930. Further, the depressed portions 934 of the edge also extend a height less than the raised portions 932. In some embodiments, the depressed portions 934 also extend a height less than the central raised portion 936, but it may be greater than convex raised portions 936 in other embodiments.

Figure 14:
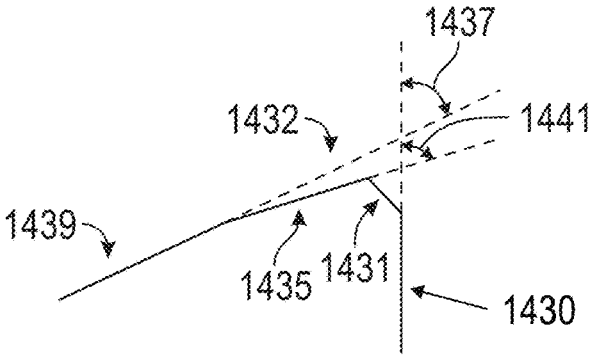
FIG. 14 is a view of a cutting element according to one or more embodiments of the present disclosure.

In some embodiments, a raised portion of an edge may include multiple portions, but may not include a flat portion. FIG. 14, for instance, illustrates one or more embodiments of a cutting element that includes a continuous, piecewise acute angle portion. The cutting element shown in FIG. 14, has two portions 1435 and 1439 that each have an edge angle (1437 and 1441) that is less than 90°. In particular, a first inclined portion 1435 immediately adjacent the bevel 1431 may be inclined to be at a first acute edge angle 1441. The acute edge angle 1441 as measured between lines 1432 tangent to the first inclined portion 1435 and the side of the cutting element 1430 may be of a range that is greater than 45°, greater than 60°, or greater than 70° and up to 89°. For instance, the acute edge angle 1441 may be between 60° and 89°, or between 75° and 85°. The second inclined portion 1439 may be adjacent the first inclined portion 1435, and may extend toward a recessed portion (now shown). The edge angle 1441 of the second inclined portion 1439 may be of a range that is greater than 35°, greater than 45°, or greater than 60° and up to 89°. For instance, the acute edge angle 1441 may be between 50° and 80°, or between 65° and 75°. In FIG. 14, edge angle 1437 can be acute, 90° or obtuse.

Figure 10:
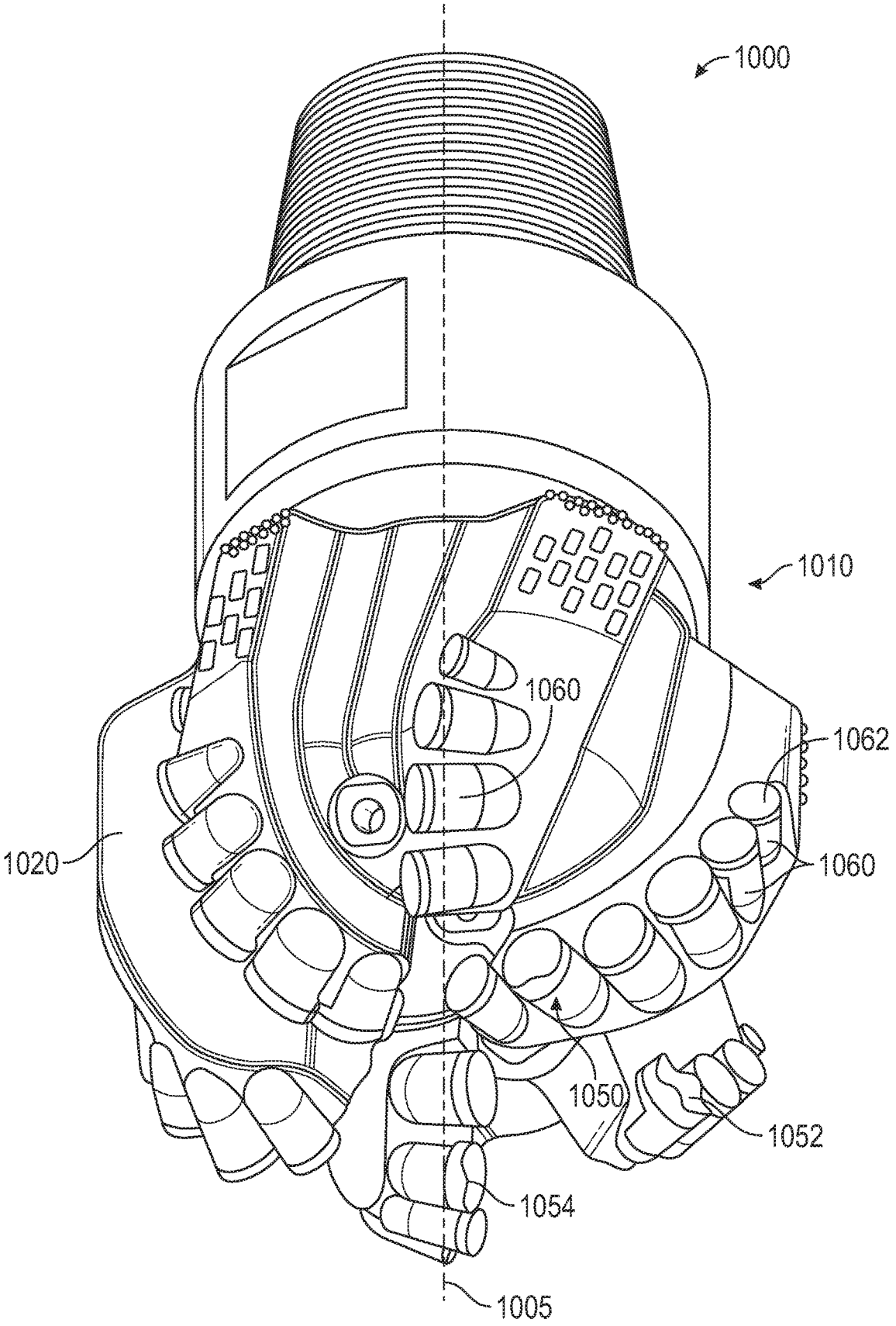
FIG. 10 shows a drill bit according to one or more embodiments of the present disclosure.

Cutting elements according to embodiments of the present disclosure may be secured to, or otherwise positioned on a cutting tool in an orientation to have a selected effective back rake, or engagement angle. For example, FIG. 10 shows an example of a drill bit 1000 having a cutting element 1050 according to embodiments of the present. The bit 1000 includes a bit body 1010 having a longitudinal axis 1005 extending therethrough and a plurality of blades 1020 extending outwardly from the body 1010. Cutter pockets are formed in the blades 1020 in a selected orientation for receiving cutting elements. Cutting elements 1060 having planar cutting faces 1062 are optionally in some of the cutter pockets, and cutting elements 1050 having non-planar cutting faces 1052 according to embodiments disclosed herein are disposed in some cutter pockets. The non-planar cutting faces 1052 include at least one acute edge angle portion 1054 of the cutting element edge oriented as a cutting edge to engage a formation during drilling. According to embodiments of the present disclosure, at least one cutting element having a non-planar cutting face as disclosed herein may be on a cutting tool, such as the drill bit 1000 shown in FIG. 10, to form the cutting profile of the cutting tool.

The engagement angle formed between the cutting elements 1050, 1060 as they engage a formation may depend on the orientation of the cutter pocket in which the cutting elements are positioned, and the surface geometry of the cutting faces 1052, 1062. For example, an engagement angle may be varied by varying the orientation of a cutter pocket relative to the bit (varying the angle between the line tangent to the cutter pocket side wall relative to the cutting tool axis), and/or, an engagement angle may be varied by varying the surface geometry of a non-planar cutting face (e.g., such that a selected edge angle is provided as the cutting edge). In some embodiments, an engagement angle formed between a formation and a non-planar cutting element (having different edge angles formed around the edge of the non-planar cutting face) may be varied by rotating the non-planar cutting element within a cutter pocket to provide the different edge angles of the non-planar cutting face as the cutting edge. Accordingly, non-planar cutting elements according to embodiments disclosed herein may be used to alter one or more engagement angles on a cutting profile of an already formed cutting tool. Thus, in some embodiments, rather than (or in addition to) designing or altering a cutter pocket orientation relative to the cutting tool in which the cutter pocket is formed in order to provide a selected engagement angle between a cutting element in the cutter pocket and a formation, a non-planar cutting element according to embodiments of the present disclosure may be in an already formed cutter pocket to have an edge angle oriented in the cutting edge position in the cutter pocket in order to provide the selected engagement angle. In some embodiments, non-planar cutting elements 1050, 1052 may have a desired engagement angle while the cutter pocket is at a back rake angle that is between 5° and 50° or between 10° and 45°. This may include non-planar cutting elements 1050, 1052 in the cone, nose, shoulder, or gage regions of the bit, or in any combination of the cone, nose, shoulder, and gage regions of the bit.

Figure 11A:
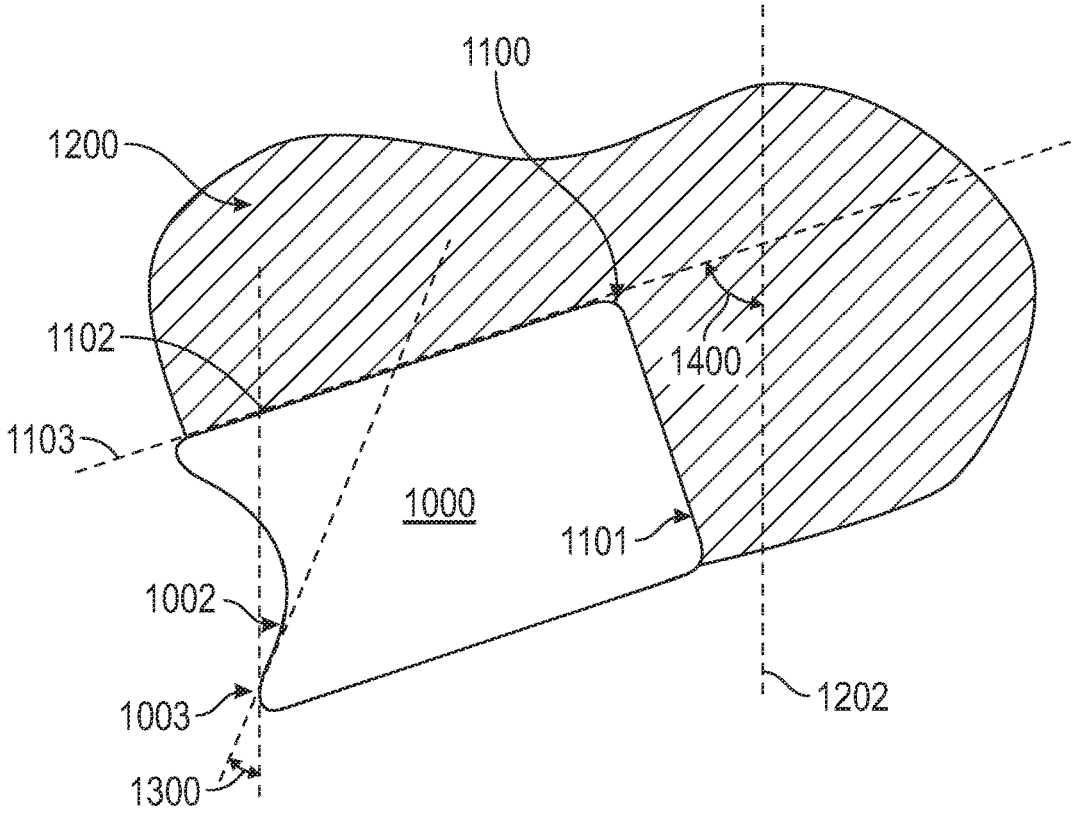
FIGS. 11A and 11B are cross-sectional views of a cutting element at different orientations within a cutter pocket according to one or more embodiments of the present disclosure.
Figure 11B:
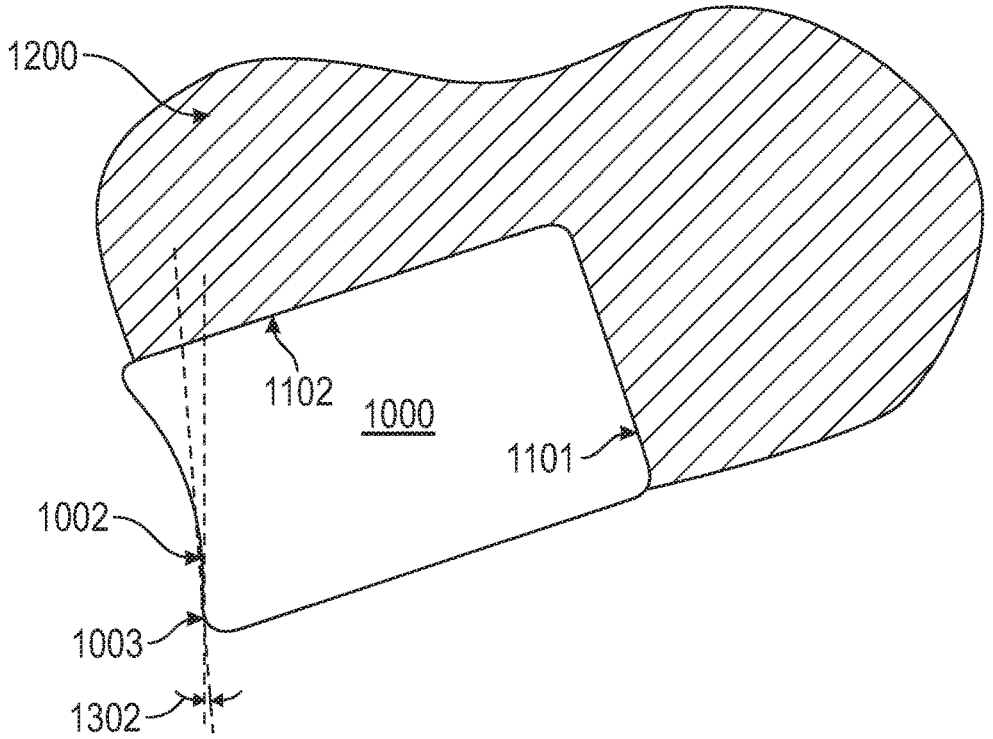

FIGS. 11A and 11B show an example of how an engagement angle may be altered using a cutting element according to embodiments of the present disclosure. In FIGS. 11A and 11B, two different orientations of a cutting element 1000 within a cutter pocket 1100 are illustrated. The cutter pocket 1100 has a bottom wall 1101 (shown as interfacing a base surface of the cutting element 1000) and a side wall 1102 (shown as interfacing a side surface of the cutting element 1000) and is formed along a cutting portion of a cutting tool 1200. The cutting element 1000 has a non-planar cutting face 1002 that includes different edge angles along the perimeter of the cutting face 1002. At a first rotational orientation in the cutter pocket 1100, a first acute edge angle portion of the cutting face 1002 is positioned as a cutting edge 1003 of the cutting element, where the first acute edge angle at the cutting edge 1003 forms a positive engagement angle 1300. At a second rotational orientation in the cutter pocket 1100, a second acute edge angle portion of the cutting face 1002 is positioned as the cutting edge 1003, where the second acute edge angle at the cutting edge 1003 forms a negative engagement angle 1302. As shown, the engagement angle formed by a cutting element according to embodiments of the present disclosure may be altered within a single cutter pocket by rotating the cutting element within the cutter pocket to provide a different edge angle portion at the cutting edge. In some embodiments, a cutting element according to embodiments of the present disclosure may be rotated within a single cutter pocket from a position having an acute edge angle portion of the cutting element at the cutting edge to a position having a right edge angle portion at the cutting edge and/or to a position having an obtuse edge angle portion at the cutting edge.

Further, as shown in FIG. 11A, a positive engagement angle 1300 may be formed by a cutting element 1000 according to embodiments of the present disclosure when the cutter pocket 1100 in which the cutting element 1000 is located would otherwise orient a conventional cutting element to have a negative back rake angle. As shown, the cutter pocket 1100 may be oriented to have a line 1103 tangent to the side wall 1102 extending at an acute angle 1400 with a longitudinal axis 1202 of the cutting tool 1200 on which the cutting element 1000 is disposed. If a cutting element having a planar surface (or having a right edge angle portion positioned to be the cutting edge) were to be in the cutter pocket 1100, the back rake angle at the cutting edge would be negative.

According to embodiments of the present disclosure, an engagement angle may be altered by rotating a cutting element according to embodiments of the present disclosure within a cutter pocket formed on a cutting tool, such as a drill bit. For example, a drill bit may include a bit body having a longitudinal axis extending there through, at least one blade extending outwardly from the bit body, a cutter pocket formed in an outermost surface of the at least one blade, the cutter pocket having a side wall and a bottom wall, and a line tangent to the side wall extends downwardly from the longitudinal axis at an acute angle. A non-planar cutting element may be disposed in the cutter pocket, where the non-planar cutting element may include a body, a non-planar cutting face, and a cutting edge extending around a perimeter of the cutting face, and a plane tangent to a portion of the cutting face at the cutting edge forms a positive engagement angle (or effective back rake) with the longitudinal axis of the drill bit.

Figure 12:
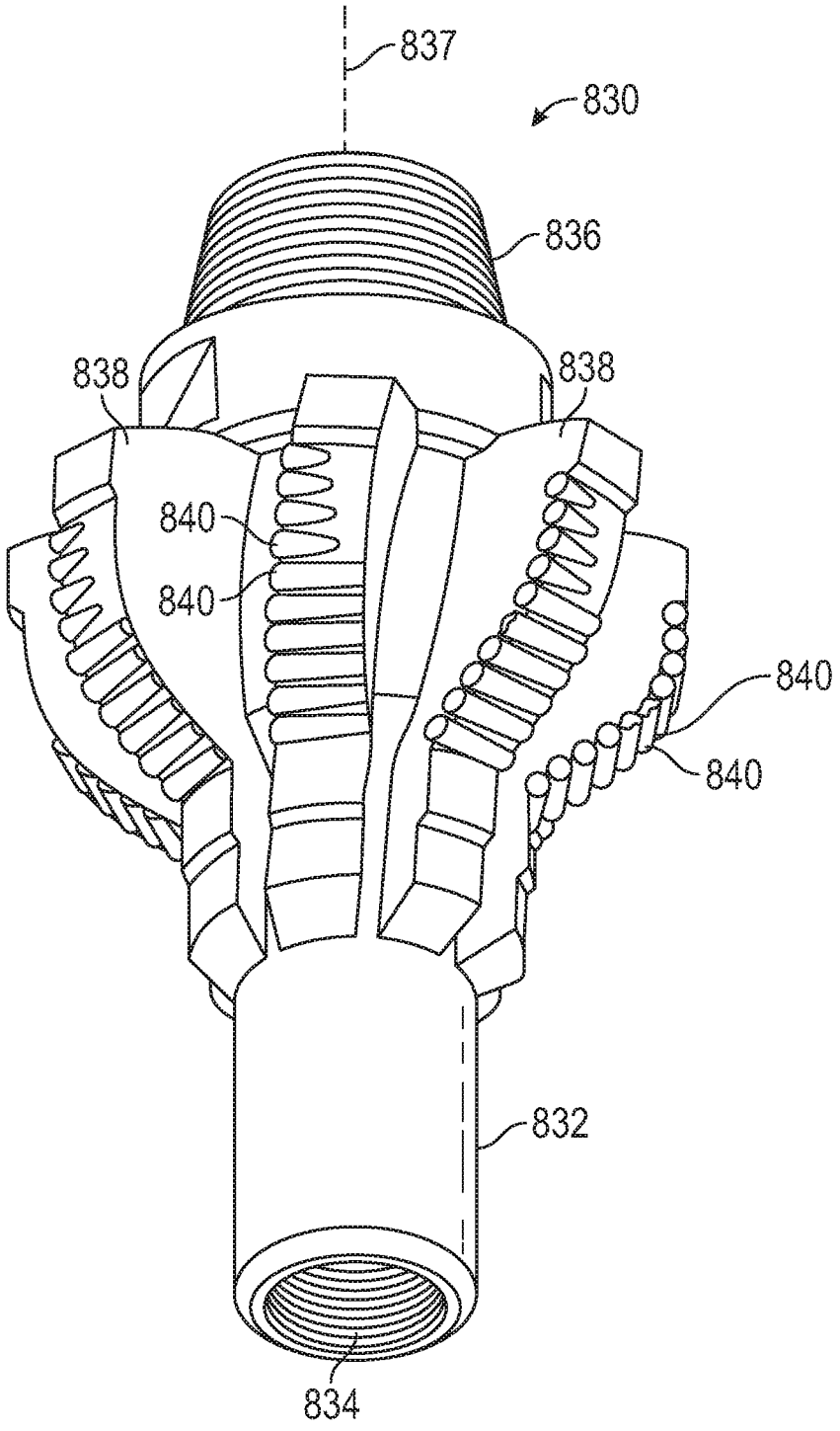
FIG. 12 shows a hole opener according to one or more embodiments of the present disclosure.

Non-planar cutting elements according to embodiments of the present disclosure may be disposed on a variety of downhole cutting tools, including, for example, drill bits, reamers, and other hole opening tools. For example, FIG. 12 shows an example of a hole opener 830 that includes one or more cutting elements 840 of the present disclosure. The hole opener 830 includes a tool body 832 and a plurality of blades 838 disposed at selected azimuthal locations about a circumference thereof. The hole opener 830 may include connections 834, 836 (e.g., threaded connections) so that the hole opener 830 may be coupled to adjacent drilling tools that include, for example, a drill string and/or bottom hole assembly (BHA) (not shown). The tool body 832 may include a bore 837 there through so that drilling fluid may flow through the hole opener 830 as it is pumped from the surface (e.g., from surface mud pumps (not shown)) to a bottom of the wellbore (not shown).

While embodiments of the present disclosure have been described with respect to drill bits and other cutting tools for use in downhole applications, the present disclosure is not limited to such environments, and may be used in other environments, including manufacturing, and utility line placement. Numbers, percentages, ratios, or other values stated herein are intended to include that value, and also other values that are "about" or "approximately" the stated value, as would be appreciated by one of ordinary skill in the art encompassed by embodiments of the present disclosure. A stated value or terms such as "about," "approximately," "generally," and the like, should therefore be interpreted broadly enough to encompass values, orientations, or features that are at least close enough to the stated value, orientation, or feature to perform a desired function or achieve a desired result. Stated values, features, and orientations include at least the variation to be expected in a suitable manufacturing or production process, and may further include deviations that are within 5%, within 1%, within 0.1%, or within 0.01% of a stated value, orientation, or feature. Where a range of values includes various lower or upper limits, any two values may define the bounds of the range, or any single value may define an upper limit (e.g., up to 50%) or a lower limit (at least 50%).

Although only a few embodiments have been described in detail above, those skilled in the art will readily appreciate that many modifications are possible in the embodiments without materially departing from this invention. It should be understood that references to "one embodiment" or "an embodiment" of the present disclosure are not intended to be interpreted as excluding the existence of additional embodiments that also incorporate the recited features. For example, any element or feature described in relation to an embodiment herein may be combinable with any element or feature of any other embodiment described herein. Accordingly, all such modifications are intended to be included within the scope of this disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function.

What is claimed is:

1. A cutting element, comprising:

a body;

a concave cutting face at a first end of the body, the concave cutting face comprising one or more cutting ridges adjacent a cutting tip that are raised above the concavity of the concave cutting face and having a length that is at least about 10% of a diameter of the concave cutting face, the concave cutting face further comprising a center dome completely surrounded by a first portion of the concave cutting face, wherein the center dome extends above the first portion; and an edge around a perimeter of the concave cutting face, the edge having an edge angle defined between a tangent of the concave cutting face and a cylindrical side surface of the body, the edge angle being acute at the cutting tip and varying around the perimeter of the concave cutting face, wherein the edge further comprises a first raised edge portion and a second raised edge portion, wherein the concave cutting face defines a valley between the first raised edge portion and the second raised edge portion, and wherein the center dome extends into the valley between the first raised edge portion and the second raised edge portion.

2. The cutting element of claim 1, wherein the one or more cutting ridges comprise two side portions and a top line that runs along the length of the ridge where the two side portions meet.

3. The cutting element of claim 1, wherein the body comprises a cutting layer on a substrate and the concave cutting face is formed on the cutting layer opposite an interface with the substrate.

4. The cutting element of claim 1, wherein the one or more cutting ridges have an inclusive angle ranging from about 60 to 170 degrees.

5. The cutting element of claim 1, wherein at least one of the cutting ridges is disposed substantially perpendicularly to a tangent of the edge at the cutting tip.

6. The cutting element of claim 1, wherein the one or more cutting ridges intersect the center dome.

7. The cutting element of claim 1, further comprising a flat region between a bevel of the edge adjacent to the cutting tip and an inclined portion of the concave cutting face.

8. The cutting element of claim 1, wherein the body comprises a curved portion or a canted portion that connects a bevel to the cylindrical side surface of the body.

9. The cutting element of claim 1, wherein the concave cutting face comprises two or more ridges.

10. The cutting element of claim 9, wherein at least a first ridge is substantially perpendicular to a tangent of the edge at the cutting tip.

11. A cutting element, comprising:

a body;

a concave cutting face at a first end of the body, the concave cutting face comprising one or more cutting ridges that are raised above the concavity of the concave cutting face;

an edge around a perimeter of the concave cutting face, the edge having an edge angle defined between a tangent of the concave cutting face and a cylindrical side surface of the body, the edge angle being acute at a cutting tip and varying around the perimeter of the concave cutting face, wherein the edge further comprises a first raised edge portion and a second raised edge portion, and wherein the concave cutting face defines a valley between the first raised edge portion and the second raised edge portion; and a center dome completely surrounded by a first portion of the concave cutting face, wherein the center dome extends above the first portion and is at a distance from the cutting tip, and wherein the center dome extends into the valley between the first raised edge portion and the second raised edge portion.

12. The cutting element of claim 11, wherein the one or more cutting ridges comprise two side portions and a top line that runs along the length of the ridge where the two side portions meet.

13. The cutting element of claim 11, wherein the one or more cutting ridges intersect the center dome.

14. The cutting element of claim 11, wherein the body comprises a cutting layer on a substrate and the concave cutting face is formed on the cutting layer opposite an interface with the substrate.

15. The cutting element of claim 11, wherein the one or more cutting ridges have an inclusive angle ranging from about 90 to 160 degrees.

16. The cutting element of claim 11, wherein at least one of the cutting ridges is disposed substantially perpendicularly to a tangent of the edge at the cutting tip.

17. The cutting element of claim 11, further comprising a flat region that is disposed between a bevel of the edge adjacent to the cutting tip and an inclined portion of the concave cutting face.

18. The cutting element of claim 11, wherein the edge further comprises a curved portion or a canted portion that connects a bevel to the cylindrical side surface of the body.

19. The cutting element of claim 11, wherein the concave cutting face comprises two or more ridges.

* * * * *